United States Patent [19]

Root et al.

[11] Patent Number: 4,706,717

[45] Date of Patent: Nov. 17, 1987

[54] HEDDLE FRAME FOR A HIGH SPEED WEAVING MACHINE

[75] Inventors: Steven J. Root, Mauldin; James D. Grigsby, Greenville, both of S.C.

[73] Assignee: Steel Heddle Manufacturing Co., Inc., Greenville, S.C.

[21] Appl. No.: 899,983

[22] Filed: Aug. 25, 1986

[51] Int. Cl.[4] ..... D03C 9/06

[52] U.S. Cl. ..... 139/92

[58] Field of Search ..... 139/91, 92

[56] References Cited

U.S. PATENT DOCUMENTS 3,016,925 1/1962 Graf ..... 139/92

4,112,980 9/1978 Bader ..... 139/92

*Primary Examiner*—Henry S. Jaudon

*Attorney, Agent, or Firm*—Julian W. Dority

[57] ABSTRACT

A heddle frame which has a pair of rectangular hollow metal cross rails, a pair of heddle bars associated with the cross rails for supporting heddles and a pair of end braces connected to said cross rails and said heddle bars and two or more connections between the cross rails and the heddle bars intermediate the end braces. The connections between the heddle bars and the cross rails comprise a hanger which may be formed of a synthetic polymeric material which is rigid, has a first portion which extends into an opening in the bottom of the hollow cross rail, and a second portion which is attached to the heddle bar. The upper portion of the hanger has a closed rectangular opening extending through it into which is fitted a metal insert of substantially the same thickness as the upper portion of the hanger. When the metal insert is placed within the hanger and the hanger is located within the hollow space of the rail, the metal insert is rigidly connected to the walls of the cross rail by means of spot welds, rivets or the like. It is essential to note that the width of the hanger is less than the width of the opening through which it extends into the rail and that the width of the closed opening within the upper portion of the hanger is greater than the width of the metal inserts. These features permit limited relative movement between the hanger and the metal inserts during stress upon the rail or the heddle bar.

17 Claims, 5 Drawing Figures

HEDDLE FRAME FOR A HIGH SPEED WEAVING MACHINE

BACKGROUND OF THE INVENTION

This invention relates to a heddle frame for a high speed weaving machine. More particularly, this invention relates to means for securing the heddle bars to the top and bottom rails.

As is known, weaving machines are frequently provided with heddle frames which comprise top and bottom rails and end braces connecting the rails and the top and bottom heddle bars which are supported by the top and bottom rails, respectively, by hangers or connectors. In such cases, the hangers are fitted into the interior of the rails through an opening in the bottom or top of the rails, as the case may be. In the past, such hangers have been made of metal and have been secured to the walls of the rails by means of rivets, screws or spot welding, providing a rigid connection between the hangers and the rails.

In other examples of the prior art, the hanger is secured in place by a resilient intermediate drive transmitting element which is usually disposed between the hanger and the rail.

As described in U.S. Pat. No. 4,249,579, a hanger is provided which has a portion that extends into the interior of a top rail or shaft, as described by the patent. The hanger is secured in the shaft or rail by a resilient member which is inserted through openings in the walls of the rail and through an opening in the portion of the hanger which extends into the interior of the rail. The hanger of this patent provides resiliency in the connection between the rail and the heddle bar but permits relative movement between the heddle bar and the rail in all directions, due to the resiliency of the rubber inserts which anchor the hanger in the interior of the rail. Furthermore, in this device, the weight of the heddle bars, the heddles, and the warp is all concentrated on the shoulders of the insert which engages the thin walls of the rail. Extended exposure to the reciprocating forces normally encountered in high speed weaving machines causes the walls of the rail to cut or abrade the rubber inserts and results in failure of the connection.

SUMMARY OF THE INVENTION

Accordingly, it is an object of the invention to provide a dimensionally stable means for mounting a hanger within the rail of a heddle frame on a weaving machine.

It is another object of the invention to provide a hanger of relatively simple construction which may be firmly secured within the hollow rail.

It is yet another object of the invention to provide a hanger which, while rigidly connected to the rails, still permits limited relative movement between the hanger and the rail so as to avoid undue stress on the hanger during the weaving operation caused by the flexing of the rails or heddle rods.

Briefly, the invention is directed to a heddle frame which has top and bottom rails formed of a hollow rectangular cross beam of aluminum or other metal. Each of the rails has associated with it, a heddle bar which is connected to the rail by two or more hangers. Each of the hangers comprises a rigid member formed of a synthetic material which may be formed of nylon, polyacetyl, POM (polyoxymethylene). The upper portion of the hanger is adapted to fit snugly within the walls of the hollow rail and enters into the hollow portion of the rail through one or more openings associated with the hangers.

The portion of the hanger which enters into the rail has a rectangular closed opening therein into which is inserted a metal insert of the same thickness as the portion of the hanger which extends into the rail. The height of the metal insert is substantially the same as that of the elongated opening in the hanger portion but the width of the metal insert is less than the length of the elongated opening in the portion of the hanger, so as to permit relative lateral movement between the insert and the hanger.

After the hanger and the insert is inserted into the interior of the hollow rail, into a predetermined position, the metal insert is then secured to the walls of the metal rail by means of rivets, spot welds or the like, thereby permitting relative motion between the hanger and the rail in the lateral direction while securely connecting the hanger to the rail in the vertical direction. Thus, relative lateral motion between the heddle bar supported by the hangers and the associated rail is permitted while vertical relative movement between the rail and the heddle bar is not permitted.

DETAILED DESCRIPTION

Figure 1:
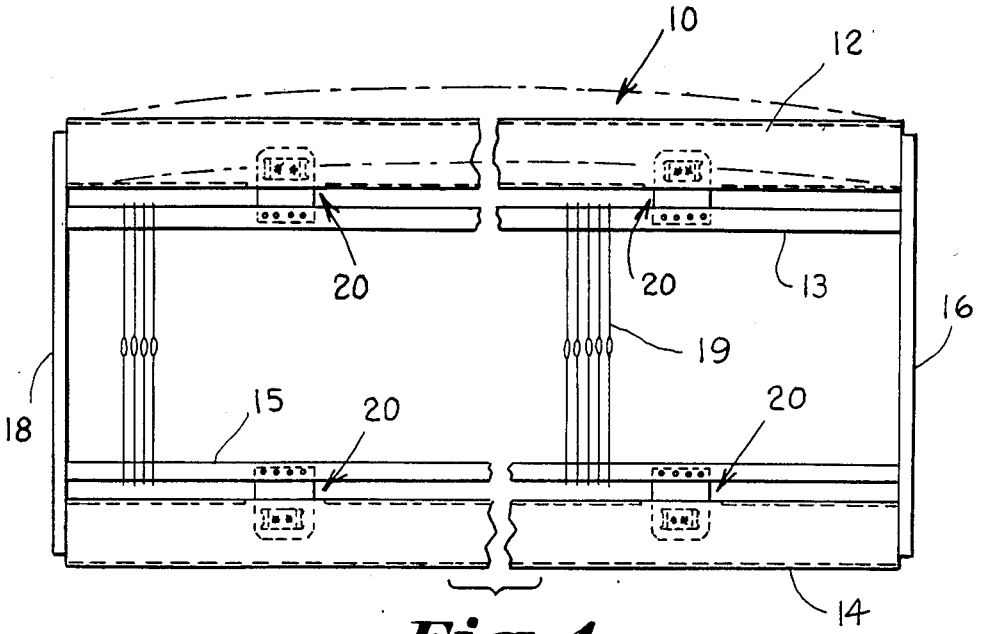
FIG. 1 illustrates a front view of a heddle frame constructed in accordance with the invention.

Referring now to FIG. 1 of the drawings, it will be seen that heddle frame 10 comprises a top rail 12 and a bottom rail 14, which have associated therewith a top heddle bar 13 and bottom heddle bar 15, respectively. The top and bottom rails and the top and bottom heddle bars are supported at each end by means of end braces 16 and 18. Heddle bars 13 and 15 in turn support plurality of heddle 19. Immediate end braces 16 and 18 are two or more hangers 20 which connect the heddle bars to their respective rails for support therewith.

Figure 2:
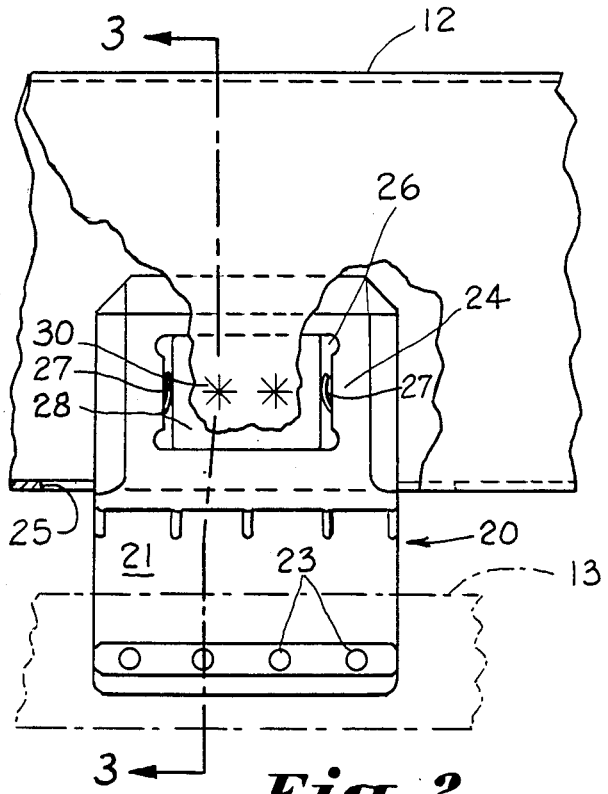
FIG. 2 is a view on an enlarged scale of one of the connections between the hanger and the rail with portions broken away for clarity.
Figure 3:
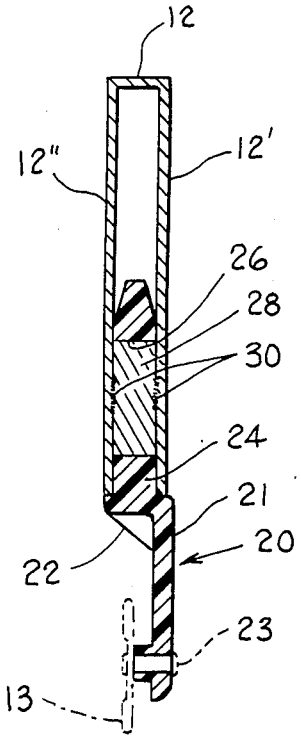
FIG. 3 is a sectional view of the connection of FIG. 2 taken along line 3—3 of FIG. 2.

Referring now to FIGS. 1, 2 and 3, the connection between top rail 12 and its associated heddle bar 13 comprises a hanger 20 which has a lower portion 21 which supports heddle bar 13 by means of one or more rivets or other metal fasteners 23. Hanger 20 also has an upper portion 24 which has a thickness substantially equal to the width of the hollow within rail 12. Upper portion 24 is adapted to enter into the interior of the rail through an elongated opening 25 which opening is wider than the width of the hanger.

Upper portion 24 is provided with a closed rectangular opening 26. Fitted within opening 26 is a metal insert 28 which has a height substantially the same as the inner height of the closed rectangular opening but whose width is less than the width of the opening so as to provide clearance and for relative lateral movement between the inserts and the upper portion of the hanger. Each of the vertical walls of rectangular opening 26 is provided with a spacer 27 to aid in the assembly of the hanger. Spacer 27 may be frangible or resilient. In either event spacer 27 centers the insert within the opening during assembly but does not significantly interfere with the lateral movement of the insert when the rails bow under stress. Where the spacer is frangible, it will break away under stress and where a flexible or resilient spacer is used, its resilience will assist in returning the insert to its center position when the stress is removed.

During assembly, the metal insert is fitted within the closed opening 26 and the upper portion of the hanger is then inserted into the interior of the hollow rail. After it is inserted, the metal insert is attached to walls 12′ and 12″ by means of spot welds, rivets or the like, thereby rigidly connecting the metal insert to the walls of the rail.

It should be noted that lower portion 21 (as seen in FIG. 3) is offset from the vertical plane in which lies upper portion 24 and that lower portion 21 is connected to the upper portion 24 and is further connected thereto by means of a plurality of ribs 22 to lend strength and stability to the hanger. It should be noted that heddle bar 13 is supported directly under the center of top rail 12.

Figure 4:
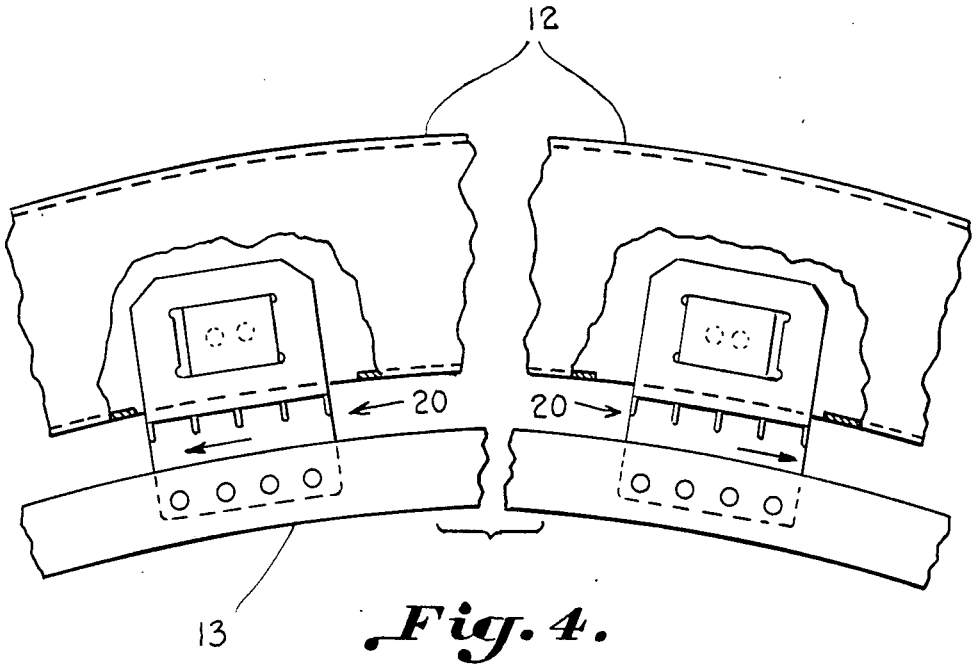
FIG. 4 is an enlarged view of the top rail of the heddle frame of FIG. 1 with parts of the rail wall broken away to illustrate relative lateral movement between the hangers and the rail, when the rail is deflected upwardly.
Figure 5:
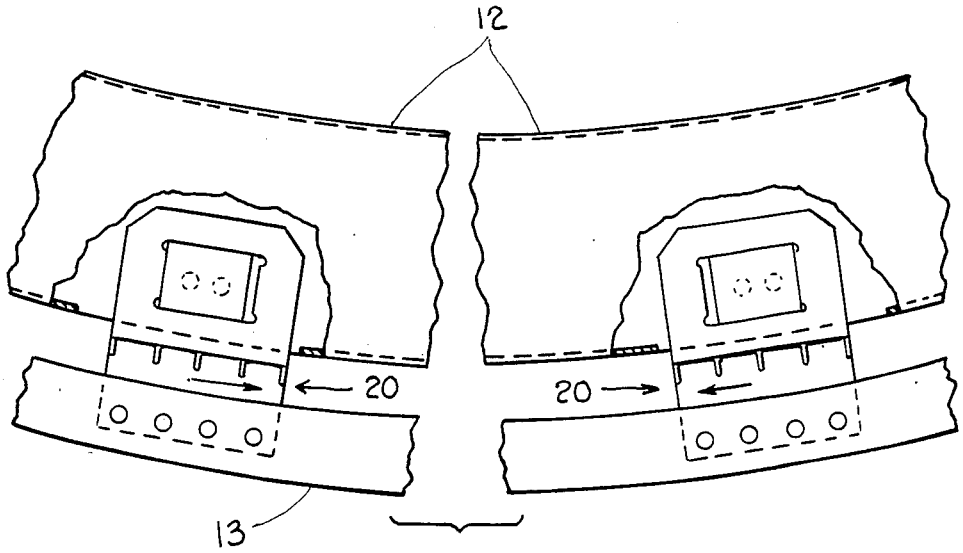
FIG. 5 is an enlarged view illustrating the top rail of the heddle frame of FIG. 1, with parts of the rail wall broken away to illustrate relative movement between the hanger and the top rail when the top rail is deflected downwardly.

Referring now to FIGS. 4 and 5, in FIG. 4 it will be noted that when the center of rail 12 is deflected upwardly, insert 28 permits the hangers 20 to move outwardly to relieve the stress which would normally be applied to the hangers during the bending of the rail. In FIG. 5, when rail 12 is bent downwardly, hangers 20 are permitted to move towards the center of the frame, again to avoid unduly stressing the connection between the hangers and the rails.

While opening 26 has been described as closed and rectangular, it is obvious that opening 26 need not have continuous walls to perform its function. It is necessary only that the top and bottom walls be in sliding contact with the top and bottom surfaces of the insert. Further, the opening could be an elongated oval with the insert having a similar shape, provided that the top and bottom surfaces of both the insert and the opening permit relative sliding movement between the insert and the top and bottom walls of the opening.

While the invention has been described herein as having the hangers made of a synthetic material and the rails and the inserts being made of metal, it is obvious that those skilled in the art can select the appropriate materials as well as the appropriate means for connecting the insert to the walls of the rail without departing from the scope of the appended claims.

What is claimed is:

1. In a heddle frame having a metal cross rail, a heddle bar for supporting heddles connected to the cross rail at at least two spaced points, at least one of the connections between the heddle bar and the rail comprising:

(a) an opening in the cross rail;

(b) a rigid hanger having a first end portion which extends into said opening in said cross rail which has a width less than the length of said opening and which has a second end portion connected to said heddle bar;

(c) an elongated substantially rectangular opening in the first end portion of said hanger; and (d) a rigid, substantially rectangular insert having a length which is less than the width of the opening in said first end portion disposed within said opening in said end portion and having at least one rigid connection to the side walls of said rail, whereby said hanger is retained within said rail while permitting limited lateral movement of the hanger relative to said cross rail.

2. In a heddle frame as set forth in claim 1 wherein said hanger is formed of a rigid synthetic polymeric material.

3. In a heddle frame as set forth in claim 1 wherein the top and bottom of the insert are in sliding contact with the top and bottom interior walls of said opening.

4. In a heddle frame as set forth in claim 1 wherein said insert is metal and secured to the walls of the rail by means of spot welding.

5. In a heddle frame as set forth in claim 1, wherein said insert is secured to the walls of the rail by means of rivets.

6. In a heddle frame as set forth in claim 1, wherein said insert is secured to the walls of the rail by means of screws.

7. In a heddle frame as set forth in claim 1, wherein said insert is secured to the walls of said rail by adhesive means.

8. In a heddle frame as set forth in claim 1, wherein said opening in said hanger is provided with means for centering the insert within said opening.

9. In a heddle frame as set forth in claim 8, wherein said centering means is frangible.

10. In a heddle frame as set forth in claim 8, wherein said centering means is resilient.

11. In a heddle frame having a cross rail, a heddle bar for supporting heddles connected to the cross rail at at least two spaced positions, at least one of said connections between the heddle bar and the rail comprising:

(a) an opening in the cross rails having two spaced longitudinally extending walls;

(b) a rigid hanger having a first end portion which extends into said opening in said cross rail which has a width less than the length of said opening and which has a second end portion connected to said heddle bar;

(c) an elongated substantially rectangular opening in the first end portion of said hanger;

(d) a rigid, substantially rectangular insert having a thickness substantially equal to the space between said longitudinal walls of said opening in the cross rail and a length which is less than the width of the opening in said first end portion of said hanger, said insert being disposed within said opening in said end portion, said insert being centered within said opening by spacer means interposed between said insert and the end walls of said opening, and having at least one rigid connection to the longitudinal walls of said opening in said cross rail, whereby said hanger is retained within the opening in said rail and substantially centered within the opening in said end portion, while permitting limited lateral movement of the hanger relative to said cross rail.

12. In a heddle frame as set forth in claim 11, wherein said hanger is formed of a rigid synthetic polymeric material.

13. In a heddle frame as set forth in claim 11, wherein the opening in the first portion of said hanger is elongated with the top and bottom walls thereof generally parallel and said insert has top and bottom surfaces which conform with said top and bottom walls of said opening.

14. In a heddle frame as set forth in claim 11, wherein said rail and said insert are metal and said insert is secured to the longitudinal walls of said rail by means of spot welding.

15. In a heddle frame as set forth in claim 11, wherein said insert is secured to the longitudinal walls of said rail by means of rivets.

16. In a heddle frame as set forth in claim 11, wherein said insert is secured to the longitudinal walls of said rail by means of screws.

17. In a heddle frame as set forth in claim 11, wherein said insert is secured to the longitudinal walls of said rail by means of an adhesive.

* * * * *